US008932064B2

(12) United States Patent
Jacobs et al.

(10) Patent No.: US 8,932,064 B2
(45) Date of Patent: Jan. 13, 2015

(54) ELECTRICAL CONNECTOR COUPLED TO A FRAME ROTATABLY COUPLED TO A BRACKET AND AN ENCLOSURE

(75) Inventors: John Jacobs, Brea, CA (US); Thomas Dale Peterson, Covina, CA (US)

(73) Assignee: R.A. Phillips Industries, Inc., Santa Fe Springs, CA (US)

( * ) Notice: Subject to any disclaimer, the term of this patent is extended or adjusted under 35 U.S.C. 154(b) by 0 days.

(21) Appl. No.: 13/584,642

(22) Filed: Aug. 13, 2012

(65) Prior Publication Data

US 2013/0040467 A1 Feb. 14, 2013

Related U.S. Application Data

(60) Provisional application No. 61/523,240, filed on Aug. 12, 2011.

(51) Int. Cl.
*H01R 13/46* (2006.01)
*H01R 35/04* (2006.01)

(52) U.S. Cl.
CPC ..... *H01R 35/04* (2013.01)
USPC ..... 439/13

(58) Field of Classification Search
USPC ..... 439/13, 157–159, 347, 364, 701
See application file for complete search history.

(56) References Cited

U.S. PATENT DOCUMENTS

| | | | | |
|---|---|---|---|---|
| 2,975,297 | A | 7/1959 | O'Neil | |
| 4,302,066 | A | 11/1981 | Newman et al. | |
| 5,393,242 | A | 2/1995 | VanDerStuyf | |
| 5,645,439 | A * | 7/1997 | Nugent et al. | 439/159 |
| 6,878,002 | B2 * | 4/2005 | Osawa et al. | 439/157 |
| 7,404,591 | B2 | 7/2008 | Bender | |
| 7,643,271 | B2 | 1/2010 | Phillips et al. | |
| 2004/0214460 | A1 * | 10/2004 | Osawa et al. | 439/157 |

OTHER PUBLICATIONS

International Search Report, dated Oct. 19, 2012 for International Application No. PCT/US2012/050637, 1 page.

* cited by examiner

*Primary Examiner* — Chandrika Prasad
(74) *Attorney, Agent, or Firm* — Christie, Parker & Hale LLP

(57) ABSTRACT

An apparatus for supporting an electrical connection, the apparatus including attachment means for enabling the apparatus to be mounted to a surface, a frame means rotatably coupled to the attachment means, an electrical connection coupled to the frame means, and an electrical wire coupled to the electrical connection.

10 Claims, 4 Drawing Sheets

ELECTRICAL CONNECTOR COUPLED TO A FRAME ROTATABLY COUPLED TO A BRACKET AND AN ENCLOSURE

CROSS-REFERENCE TO RELATED APPLICATIONS

This application claims priority to U.S. Provisional Application Ser. No. 61/523,240, filed Aug. 12, 2011, entitled SWIVEL SOCKET, which is incorporated herein in its entirety by this reference.

BACKGROUND

The present invention relates to the field of trucks and trailers.

Oftentimes, trailers (e.g., trailers that are hitched to, and towed behind, trucks or other vehicles) will include stop lights, turn signals, brakes, or other devices. Sometimes these various devices are to be operated via the interior of the vehicle pulling the trailer. The operation of these devices may be done electrically by coupling one or more electrical wires from the trailer to corresponding wires of the vehicle used to tow the trailer (e.g., via a plug and socket). Accordingly, by operating the corresponding devices of the vehicle (e.g., by a turn signal switch or brake pedal), a signal may be sent via one of the wires of the vehicle through the electrical coupling and to the wires of the trailer, thereby enabling the vehicle operator to effectively control the components of the trailer.

When driving a vehicle towing a trailer in reverse, such as when backing the a trailer into a loading dock, the vehicle operator or truck driver may perform what may be referred to as a "jackknife" maneuver. This maneuver can cause the angle between the trailer and the vehicle towing the trailer to change, which may in turn change the angle of the abovementioned wires of the vehicle with respect to the trailer wires connected thereto. For example, if the vehicle and the trailer form a 180 degree angle when the trailer is straight with the vehicle, this angle may decrease in the aforementioned scenario. This may put stress on the connection of these wires, such as a plug and socket connection, due to the fixed position of the vehicle side of the wiring connection with respect to the vehicle, thereby causing the connection or wires to become worn, damaged, or disconnected.

SUMMARY

By making a mounted electrical connection, such as a plug or socket, that is capable of some degree of rotation (e.g., is able to swivel about a vertical axis), stress upon the electrical connection and the electrical wiring between a vehicle and a trailer attached thereto, such as the stress that may be caused by changes in the angle of the trailer with respect to the vehicle, can be reduced or eliminated, thereby extending the effective life of the various wiring and connection components.

Embodiments of the present invention provide an electrical connection capable of swiveling, or partially rotating, in one or more directions with respect to the vehicle or trailer.

One embodiment of the present invention provides an apparatus for supporting an electrical connection, the apparatus including attachment means for enabling the apparatus to be mounted to a surface, a frame means rotatably coupled to the attachment means, an electrical connection coupled to the frame means, and an electrical wire coupled to the electrical connection.

The apparatus may further include an electrical connection housing for housing the electrical connection and a portion of the electrical wire coupled to the frame means, and a flap hingably coupled to the electrical connection housing.

The apparatus may further include an enclosure coupled to the attachment means for housing the electrical wire coupled to the electrical connection.

The enclosure may be configured to house a circuit breaker respectively coupled to the wire.

The frame means may be rotatably coupled to the attachment means with a bearing and o-ring through which the electrical wire passes coupled to a lower end of the frame means.

The frame means may further be rotatably coupled to the attachment means with a clevis pin through an upper end of the frame means and through a portion of the attachment means.

The attachment means may be for enabling the apparatus to be mounted to a surface of a vehicle for pulling a trailer or a surface of the trailer.

The frame means may substantially enclose the electrical connection housing.

The frame means may include a lower end having a first hole therethrough for allowing the electrical wire to pass, and a face substantially perpendicular to the lower end and having a second hole therethrough and coupled to the electrical connection.

The frame means may further include an upper end opposite the lower end and substantially perpendicular to the face, and wherein the face is between the upper end and the lower end.

The frame means may further include a back between the upper end and the lower end opposite the face, a first side between the upper end and the lower end and between the back and the face, and a second side opposite the first side and between the upper end and the lower end and between the back and the face.

Accordingly, embodiments of the present invention may provide an apparatus capable of effectively reducing strain on the aforementioned wiring and wiring connection components, thereby increasing the lifetime of the relevant equipment used.

BRIEF DESCRIPTION OF THE DRAWINGS

The accompanying drawings, together with the specification, illustrate exemplary embodiments of the present invention, and, together with the description, serve to explain aspects of embodiments of the present invention. The above and other features and aspects of the present invention will become more apparent by describing in detail exemplary embodiments thereof with reference to the attached drawings, in which.

DETAILED DESCRIPTION

Figure 1:
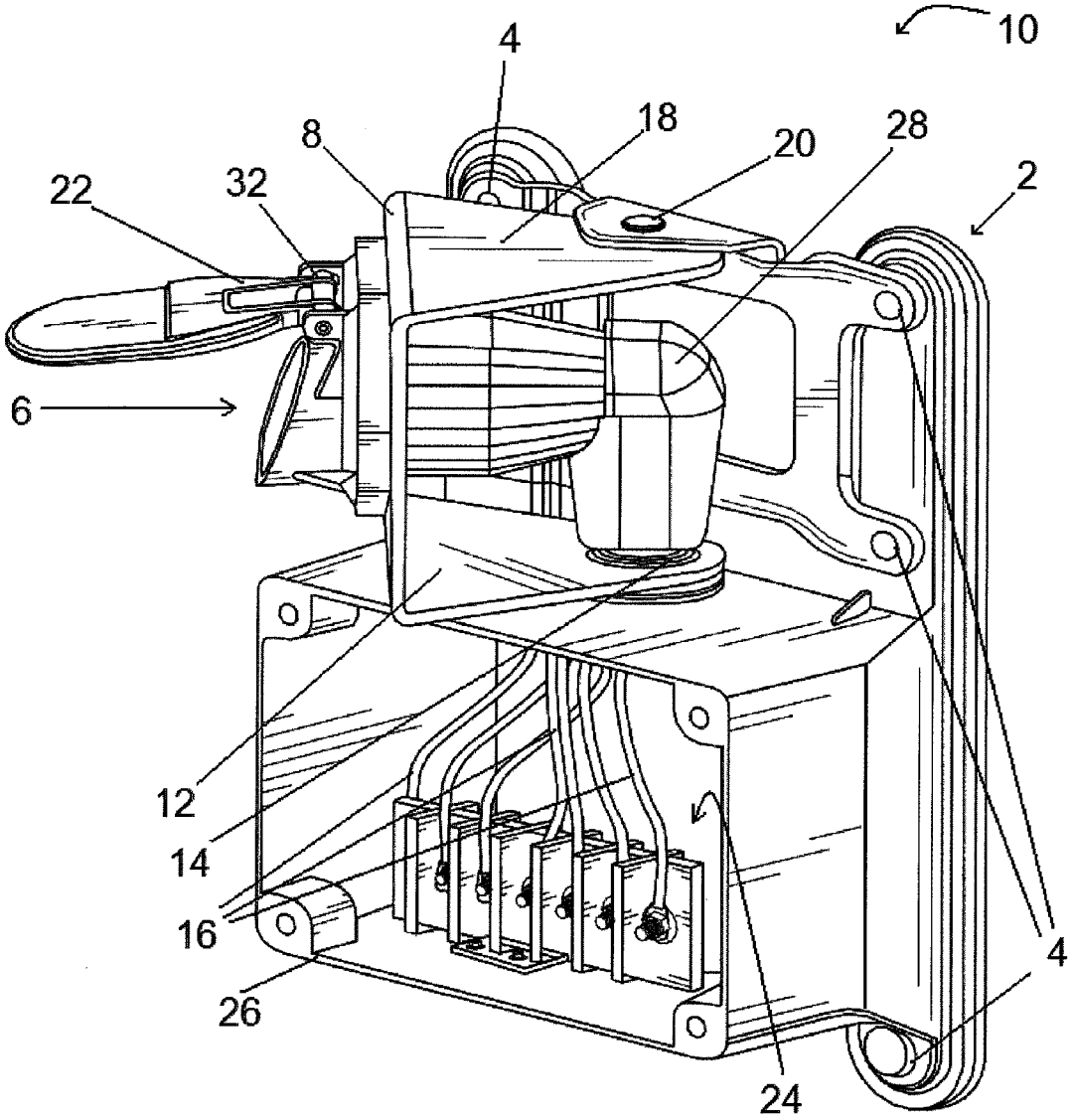
FIG. 1 is a perspective view of a first embodiment of the present invention.
Figure 2:
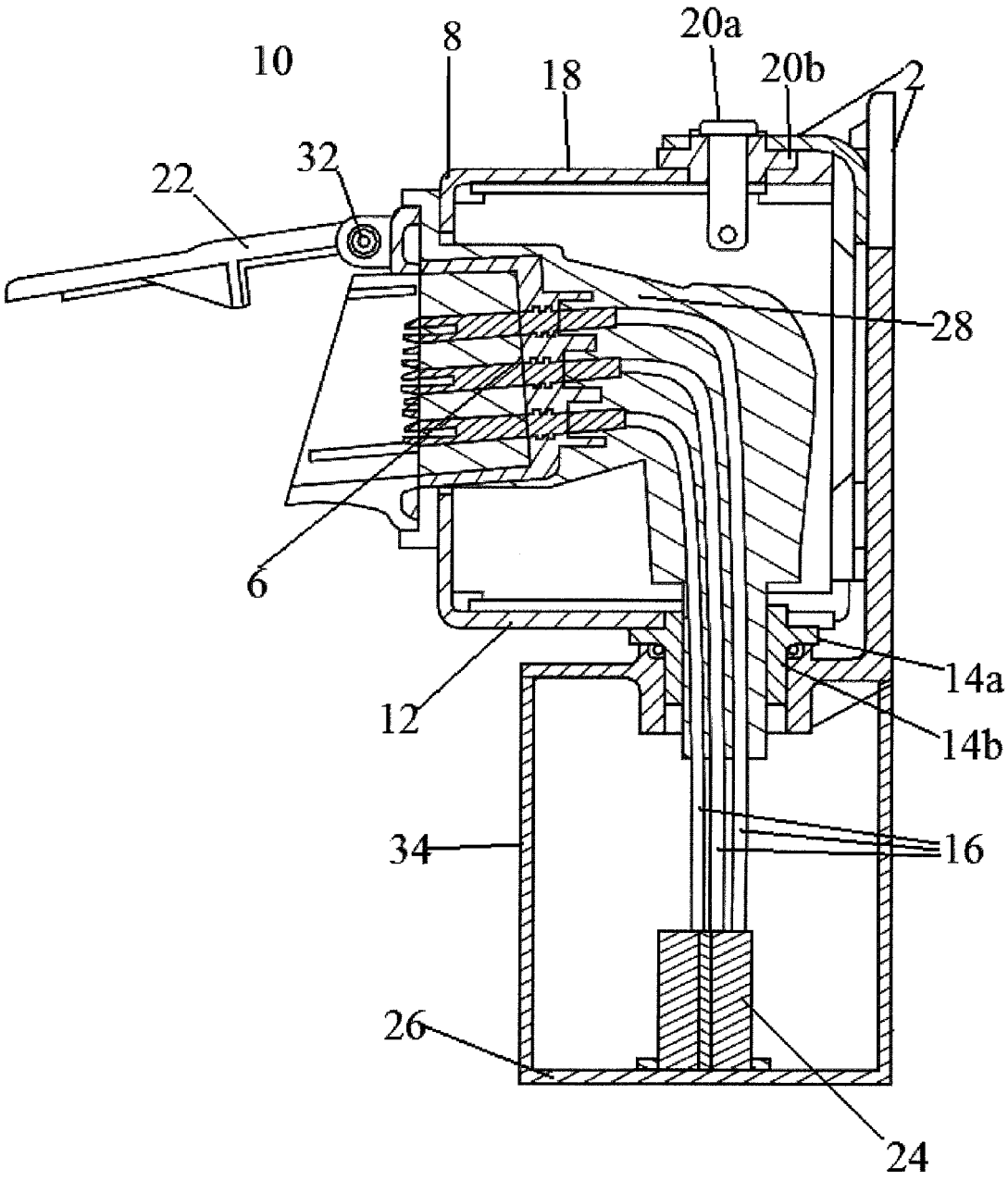
FIG. 2 is a cross-sectional view of the first embodiment taken along the line II-II.

Referring to FIGS. 1 and 2, a device 10 of a first embodiment of the present invention is shown. Although FIG. 2 is a cross sectional view of the device of the embodiment shown in FIG. 1, it should be noted that the positions shown in FIGS. 1 and 2 are not identical. For example, frame means 8 of the two figures are shown to be at a different angle with respect to attachment means 2.

The electro-mechanical device 10 of the present embodiment may be used in the truck and trailer industry. The device 10 of the present embodiment may either be attached to a portion of the vehicle towing a trailer, or attached to a trailer wall via attachment means 2, such as a bracket 2 with bolts 4 passing therethrough, although other suitable means for attachment may be used. The device 10 of the present embodiment would allow the electrical connection of electrical components of the trailer to corresponding electrical components of the vehicle via an electrical connector 6, thereby allowing control thereof by the operator of the vehicle pulling the trailer. The electrical connector 6 is coupled to the attachment means 2 so as to allow the electrical connector 6 to swivel, rotate, or otherwise move with respect to the attachment means 2. In the present embodiment, the electrical connector 6 is depicted as a socket 6, although the electrical connector 6 of other embodiments may take the form of a plug or other electrical connection means.

In the present embodiment, a 7-way trailer socket 6 is used as the electrical connector 6. The socket 6 is rotatably coupled to the attachment means 2 via frame means 8. The frame means 8 may take the form of a u-shaped bracket 8, to which the socket 6 is affixed. Furthermore, the socket 6 may be housed within a connector housing 28, which may serve to protect the electrical connector 6 as well as the components coupled thereto, while also enabling the socket 6 to be affixed to the swiveling frame means 8.

The frame means 8 may have a lower end 12 that is horizontal and that is coupled to the attachment means 2 via one or more swivel means (e.g., swivel) 14, such as a bearing 14*a* with an o-ring 14*b*. The swivel means 14 enable rotation of the frame means 8 and socket 6 with respect to the attachment means 2, and also allow one or more electrical wires 16 coupled to the socket 6 to pass through the swivel means 14 and the frame means 8. In the present embodiment, the frame means 8 also have an upper end 18 rotatably coupled to the attachment means 2 by a second swivel means 20, such as by the use of a bolt, or clevis pin 20*a*, and bearing 20*b*.

In the present embodiment, bolts 4 may pass through the attachment means 2 and into a trailer or vehicle wall, thereby enabling the attachment means 2 to be affixed to the trailer or vehicle. Accordingly, an angle between the trailer and the vehicle pulling the trailer may change (e.g., an angle corresponding to the rotation of the trailer about a vertical axis with respect to the vehicle) without a high degree of unwanted stress being placed on the connection of the electrical wires 16 via the socket 6, thereby reducing the chance that a plug placed into the socket 6 would become uncoupled from the socket 6.

In the present embodiment, additional protection to the socket 6, such as protection from weather, may be provided by a flap 22 used to cover the socket 6 when not coupled to a corresponding plug. The flap 22 may be coupled to the frame means 8 via a spring hinge 32.

Furthermore, in the present embodiment, a enclosable box-like structure (e.g., enclosure) 26 is coupled to the attachment means 2 underneath the lower end 12 of the frame means 8 and may be used to house the electrical wires 16 as well as circuit breakers 24 electrically connected thereto. The enclosable box-like structure 26 may also provide additional protection, such as protection from weather or the environment, to the circuit breakers 24, the electrical wires 16, or the electrical connections of the electrical wires 16 and the electrical connector 6. A detachable face 34 of the enclosable box-like structure 26 is depicted as removed from the enclosable box-like structure 26 in FIG. 1, and is shown attached to the enclosable box-like structure 26 in FIG. 2.

Figure 3:
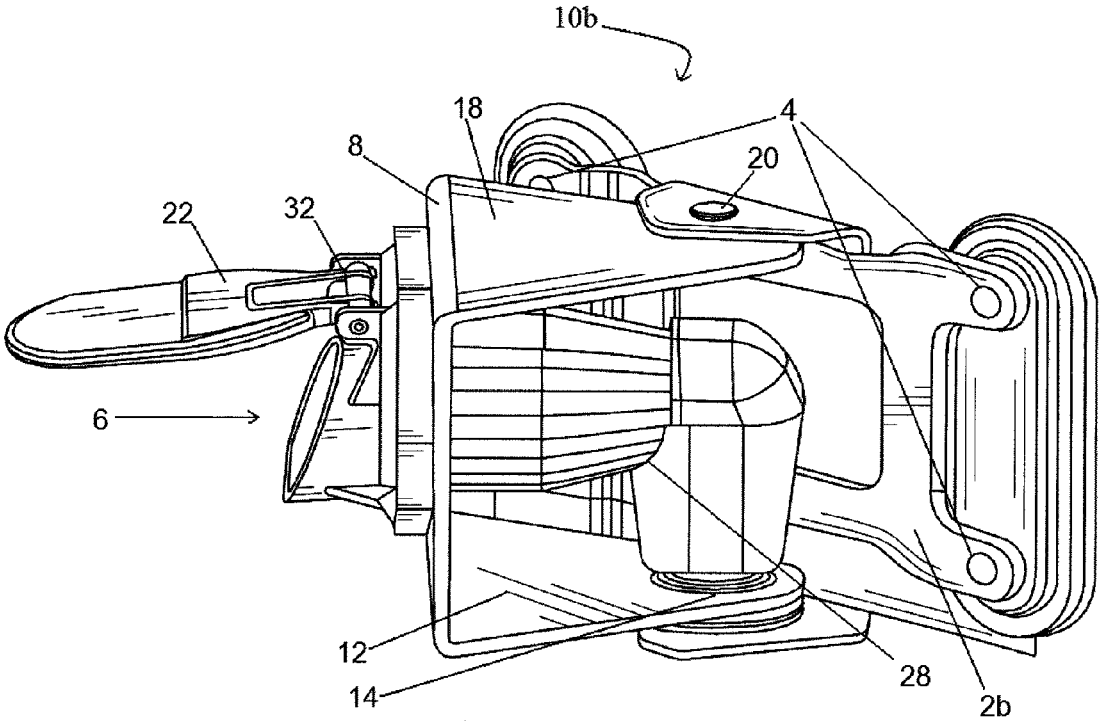
FIG. 3 is a perspective view of a second embodiment of the present invention.

Referring to FIG. 3, a device 10*b* of another embodiment of the present invention is shown. The embodiment of the device 10*b* shown in FIG. 3 is similar to the embodiment of the device 10 shown in FIGS. 1 and 2, however, the vertical sides and bottom of the enclosable box-like structure 26 shown in the previous embodiment are absent from the present embodiment, and the lower bearing/o-ring 14 is in a lower, horizontal portion of the attachment means 2*b* (e.g., a surface that is similar to an upper face of the enclosable box-like structure 26 of the previous embodiment).

Figure 4:
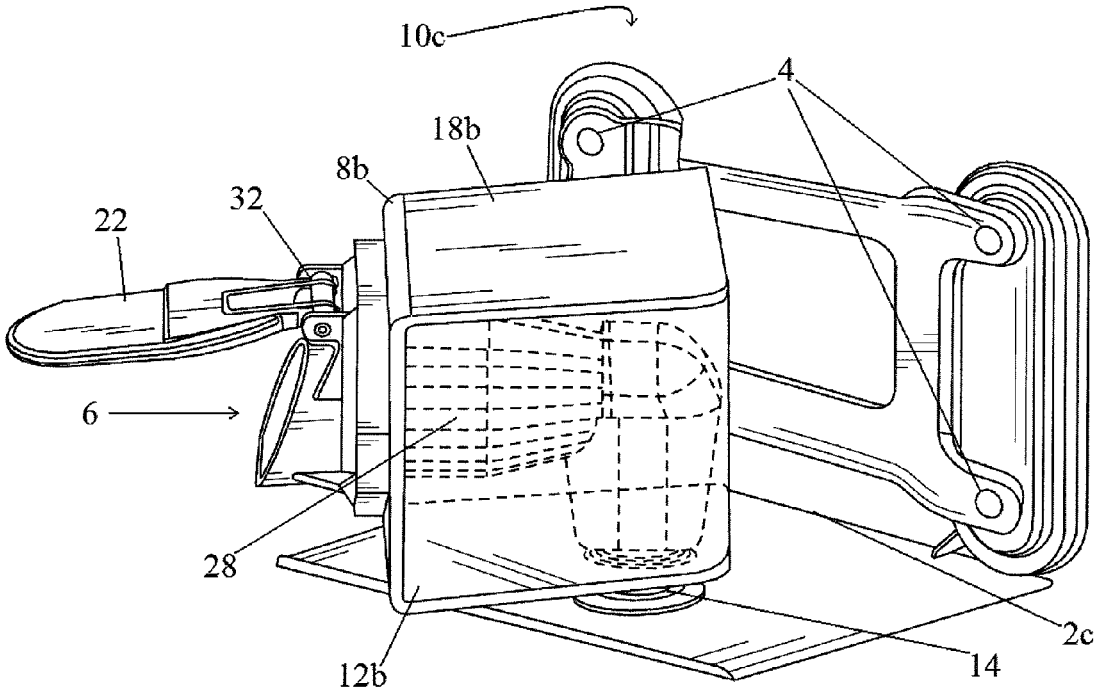
FIG. 4 is a perspective view of a third embodiment of the present invention.

Referring to FIG. 4, a device 10*c* of a third embodiment of the present invention is shown. In the present embodiment, the frame means 8*b* of the device 10*c* are coupled to the attachment means 2*c* by a lower end 12*b* of the frame means 8*b*, while an upper end 18*b* of the frame means 8*b* is not coupled to the attachment means 2*c*. Additionally, the frame means 8*b* are box-shaped and partially enclose the socket 6. The box-shaped frame means 8*b* are coupled to the lower bearing/o-ring 14 at its lower end 12*b*, and the lower bearing/o-ring 14 are coupled to the attachment means 2*c*, thereby rotatably coupling the frame means 8*b* to the attachment means 2*c*. The socket 6 within the frame means 8*b* is shown in broken line.

While the present invention has been particularly shown and described with reference to exemplary embodiments thereof, it will be understood by those of ordinary skill in the art that features of different embodiments may be combined to form further embodiments, and that various changes in form and details may be made therein, without departing from the spirit and scope of the present invention as defined by the following claims and their equivalents.

What is claimed is:

1. An apparatus for supporting an electrical connection, the apparatus comprising:

a bracket for enabling the apparatus to be mounted to a vertical surface of a vehicle or to a trailer;

a frame rotatably coupled to the bracket;

an electrical connector coupled to the frame;

an electrical wire coupled to the electrical connector; and an enclosure coupled to the bracket for housing the electrical wire coupled to the electrical connector, wherein the frame is rotatably coupled to the enclosure via a swivel through which the electrical wire passes from the electrical connector to the enclosure, the swivel being configured to enable the frame to rotate about an axis substantially parallel to the vertical surface.

2. The apparatus of claim 1 further comprising:

an electrical connector housing for housing the electrical connector and a portion of the electrical wire, the electrical connector housing being coupled to the frame; and a flap hingably coupled to the electrical connector housing.

3. The apparatus of claim 1, wherein the enclosure is configured to house a circuit breaker respectively coupled to the electrical wire.

4. The apparatus of claim 1, wherein the swivel comprises a bearing and o-ring through which the electrical wire passes coupled to a lower end of the frame.

5. The apparatus of claim 4, wherein the frame are further rotatably coupled to the bracket with a clevis pin through an upper end of the frame and through a portion of the bracket.

6. The apparatus of claim 1, wherein the bracket is for enabling the apparatus to be mounted to a surface of a vehicle for pulling a trailer or a surface of the trailer.

7. The apparatus of claim 1, wherein the frame substantially encloses the electrical connector housing.

8. The apparatus of claim 1, wherein the frame comprises:

a lower end having a first hole therethrough for allowing the electrical wire to pass; and a face substantially perpendicular to the lower end and having a second hole therethrough and coupled to the electrical connector.

9. The apparatus of claim 8, wherein the frame further comprises an upper end opposite the lower end and substantially perpendicular to the face, and wherein the face is between the upper end and the lower end.

10. The apparatus of claim 9, wherein the frame further comprises:

a back between the upper end and the lower end opposite the face;

a first side between the upper end and the lower end and between the back and the face; and a second side opposite the first side and between the upper end and the lower end and between the back and the face.

* * * * *